United States Patent [19]

Peterson

[11] Patent Number: 4,717,868

[45] Date of Patent: Jan. 5, 1988

[54] UNIFORM INTENSITY LED DRIVER CIRCUIT

[75] Inventor: Steven C. Peterson, Pocatello, Id.

[73] Assignee: American Microsystems, Inc., Santa Clara, Calif.

[21] Appl. No.: 873,239

[22] Filed: Jun. 11, 1986

Related U.S. Application Data

[63] Continuation-in-part of Ser. No. 618,615, Jun. 8, 1984, abandoned.

[51] Int. Cl.[4] ..... G05F 1/56

[52] U.S. Cl. ..... 323/288; 250/205; 307/311

[58] Field of Search ..... 323/282, 280, 265, 288; 250/205, 552; 307/270, 311; 455/613; 315/307

[56] References Cited

U.S. PATENT DOCUMENTS 3,705,316 12/1972 Burrous et al. ..... 250/205
4,101,808 7/1978 Flint ..... 250/205
4,156,166 5/1979 Shapiro et al. ..... 323/288
4,160,934 7/1979 Kirsch ..... 323/282
4,504,777 3/1985 Bauer ..... 323/288

FOREIGN PATENT DOCUMENTS 162122 12/1980 Japan ..... 323/282

*Primary Examiner*—William H. Beha, Jr.
*Attorney, Agent, or Firm*—Alan H. MacPherson; Paul J. Winters; Richard Franklin

[57] ABSTRACT

A unique driver circuit for providing constant average current through a driven element or elements having varying impedance first samples the impedance at the drive terminal in order to determine impedance of the driven elements. For increasing impedance of the driven elements, the duty cycle of the driving signal is increased, thereby resulting in a near-constant average current through the driven elements when the number of driven elements in series is changed.

6 Claims, 10 Drawing Figures

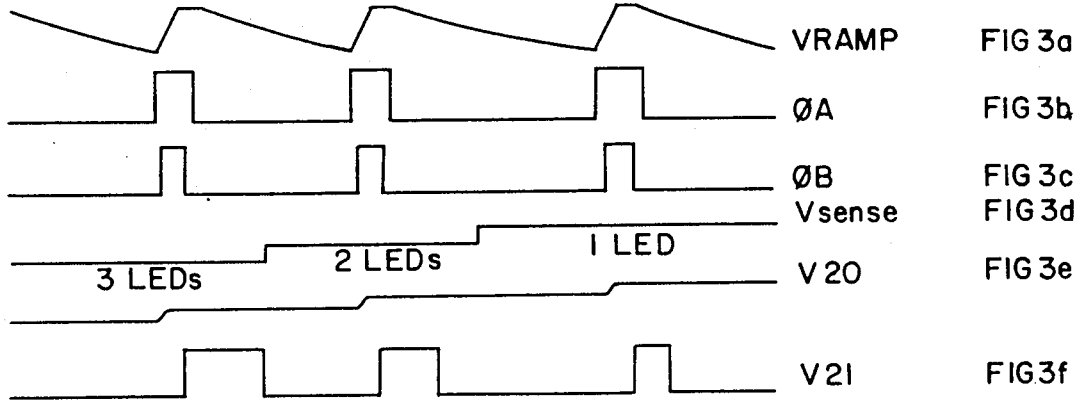
FIG 3a
FIG 3b
FIG 3c
FIG 3d
FIG 3e
FIG 3f
VRAMP
ØA
ØB
Vsense
V20
V21
1 LED
2 LEDs
3 LEDs
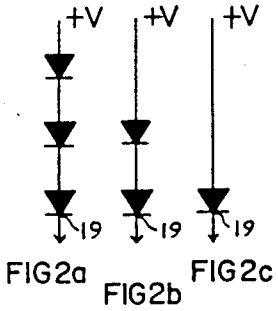
+V
+V
+V
19
19
19
FIG2a
FIG2b
FIG2c

UNIFORM INTENSITY LED DRIVER CIRCUIT

BACKGROUND OF THE INVENTION

This is a continuation-in-part of patent application Ser. No. 06/618,615, filed June 8, 1984, now abandoned.

This invention relates to electronic circuits, and more particularly to a circuit used for powering one or more devices at a predefined and uniform current level. This device finds particular use in driving light-emitting diodes (LEDs) or other light emitting devices such as incandescent bulbs, fluorescent displays and the like, and strings of such devices connected in series in order that the brightness of each device be essentially uniform regardless of the particular voltage-current characteristics of each device, and regardless of the number of devices connected in series.

Means for driving or powering light-emitting diodes in order to provide a visual indication are well-known in the prior art. One technique is to simply apply a voltage to the light-emitting diode sufficient to turn the light-emitting diode on. Alternatively, various resistance values may be connected in series with the light-emitting diode in order to limit the current flow to a selected value, depending on the voltage to be applied. Oftentimes a light-emitting diode is powered intermittently, such as by multiplexing, in order to allow a single microprocessor or other circuit to control a number of LEDs, including seven-segment readouts often found in hand-held calculators and the like.

One problem associated with such prior art means for driving light-emitting diodes is the inability to ensure that the brightness of the light emitted by each light-emitting diode is substantially uniform. U.S. Pat. No. 4,160,934 to Kirsch, entitled "Current Control Circuit for Light-Emitting Diode" shows a circuit for controlling current through a light-emitting diode in the presence of a varying supply voltage by using a comparator type feedback control network for stabilizing the voltage across an LED in series with a ballast resistor. An IGFET drive transistor is placed in series with the LED and ballast resistor and operated to have a fairly high resistance, thus providing good control of current in the presence of a varying power supply voltage.

U.S. Pat. No. 4,156,166 to Shapiro et al. teaches another circuit for providing constant brightness of a lamp in the presence of a variable power supply. The circuit of Shapiro switches the lamp on and off with a duty cycle controlled by a feed-back signal representing lamp voltage. Shapiro also discusses varying duty cycle to accommodate variation in lamp resistance, a situation more close to that of driving a variable number of LEDs. The circuit of Shapiro for accommodating variable resistance uses a four-leg bridge in which the lamp is in one leg of the bridge. Opposite points on the bridge are fed to input leads of an error amplifier which controls the duty cycle fed to the bridge elements. Impedance values of the elements arranged in the legs of the bridge are proportioned relative to the impedance exhibited by the lamp to provide a balanced bridge condition when the lamp provides the desired luminous flux output. If the resistance of the lamp increases or decreases, the error amplifier detects an unbalanced condition and adjusts the duty cycle to compensate for the imbalance. However, such a circuit can not provide an accurate adjustment in duty cycle for a wide variation in lamp impedance. Also it does not provide constant current through the lamp element or elements in the presence of varying lamp impedance.

Thus a different technique is needed to accommodate a variable impedance in order to provide constant brightness from a varying number of diodes in series, for example when a single circuit will be used to alternatively drive one, two, or three LEDs in part of a display. If a single LED were to be driven by an LED driver which provides constant voltage, it would emit maximum light. When two LEDs are connected in series and driven by this same LED driver, the decreased voltage drop across each one of the LEDs produces decreased current through the series and causes the two LEDs to emit less light. This problem becomes more important as the number of LEDs connected in the series increases.

It is not desired to form a plurality of LED driver circuits due to the increased design and manufacturing effort, as well as the increased cost. Furthermore, a single LED driver is often multiplexed to drive, at various times, any number of LEDs. Thus, the problem associated with varying brightnesses emitted by LEDs has not been solved by the prior art.

Since it is often necessary to drive as many as three LEDs in a series from a single LED driver, there is need for an LED driver which provides near constant current through an LED series having variable impedance.

SUMMARY

In accordance with the teachings of the present invention, a unique driver circuit is provided which first samples the impedance at the drive terminal in order to determine characteristics of the driven elements. For incresing impedance of the driven elements, the duty cycle of the driving signal is increased, thereby applying a greater average current to the driven elements. The teachings of this invention are applicable not only to driving strings of one or more light-emitting diodes at a uniform brightness of each light-emitting diode, regardless of the number of LEDs in the string, but also for driving other elements, including conventional light-emitting elements such as incandescent bulbs, gas discharge devices, and the like. The teachings of this invention are also applicable to driving other elements, which may or may not emit light, at near constant average currents regardless of the number of discrete elements in the driven string, or regardless of the impedance, of the driven string. A circuit may also be provided to convert an on-off current to more nearly constant current through the driven elements if this is important for the particular driven elements. Such circuits are well-known and thus not described in detail here.

BRIEF DESCRIPTION OF THE DRAWINGS

FIGS. 2*a* through 2*c* are schematic diagrams of strings of three, two and one light-emitting diodes connected in series, respectively; and FIGS. 3*a* through 3*f* are graphical representations of certain voltage waveforms within the embodiment of my invention depicted in FIG. 1.

DETAILED DESCRIPTION

Figure 1:
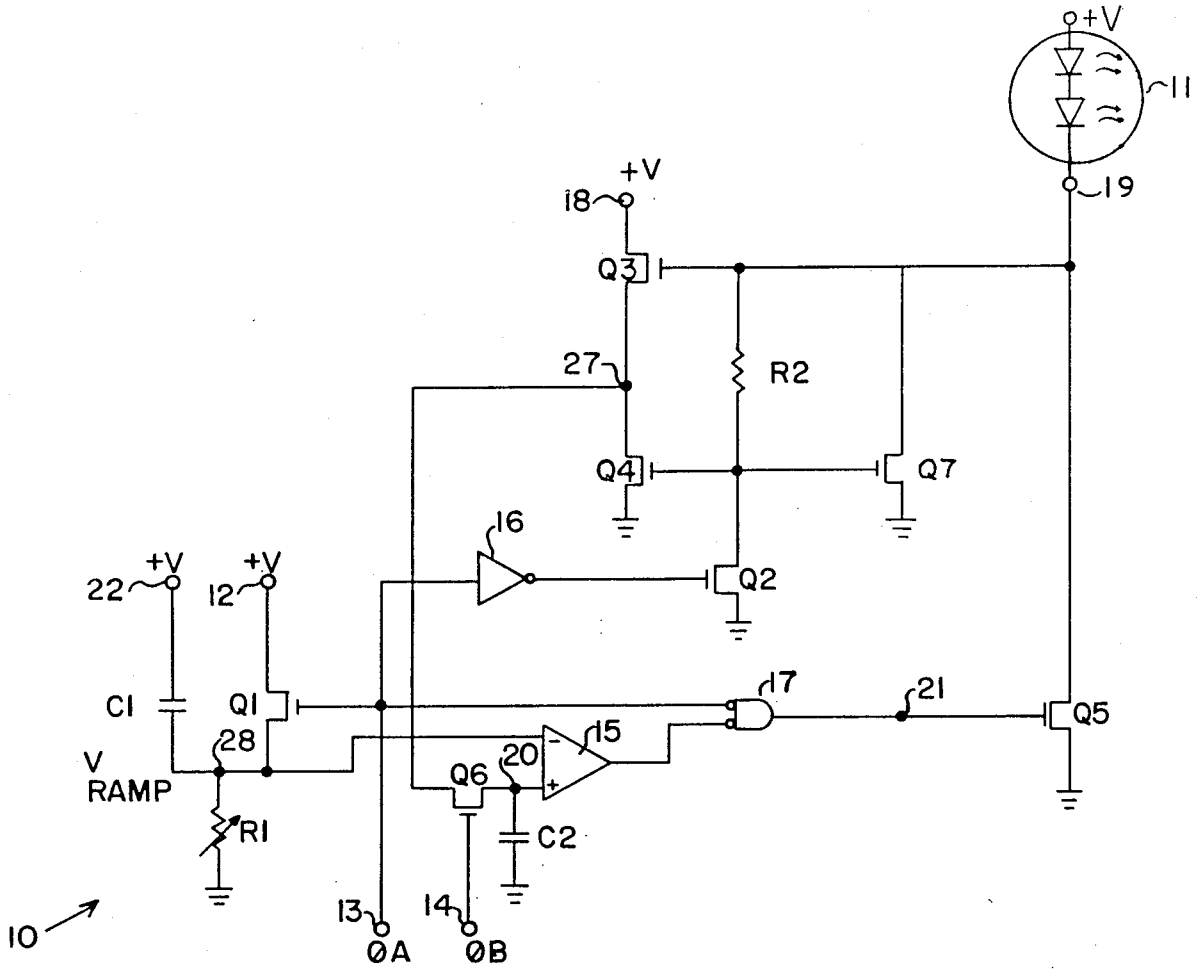
FIG. 1 is a schematic diagram of one embodiment of this invention.

One embodiment of a circuit constructed in accordance with the teachings of this invention is shown in the schematic diagram of FIG. 1. The circuit of FIG. 1 is suitable for being constructed of discrete elements, or more desirably, can be formed as a single integrated circuit device, or a small part of a larger integrated circuit device such as an integrated circuit used to fabricate electronic calculators or the like. In fact, a number of circuits such as the one shown in FIG. 1 can, if desired, be constructed on a single integrated circuit chip in order to provide a plurality of LED drivers in accordance with the teachings of this invention. Circuit 10 includes output terminal 19 for connection to a driven element 11. The driven element may be, for example, a string of light-emitting diodes connected in series. As symbolized in FIGS. *2a*, *2b* and *2c*, strings of various lengths may be driven by the circuit of FIG. 1. As shown in FIG. *2a*, the anode of a first light-emitting diode is connected to a positive voltage source +V, typically 10 volts. The three light-emitting diodes are connected in series, with the cathode of the third light-emitting diode connected to terminal 19 of circuit 10 (FIG. 1). Alternatively, as shown in FIGS. *2b* and *2c*, terminal 19 may drive two light-emitting diodes connected in series, or a single light-emitting diode. If desired, an even greater number of light-emitting diodes may be connected in series and driven by terminal 19 of circuit 10. This, of course, would require a higher operating power supply voltage (+V).

The light-emitting diodes or other driven elements connected to terminal 19 are driven by the conduction of current from the positive supply voltge +V connected to one end of driven element 11, through the driven element, and through N channel MOS output transistor Q5, which has its drain connected to terminal 19, its source connected to a second power supply terminal (in this case ground or 0 volts), and its gate connected to node 21. Output transistor Q5 is turned on intermittently in order to cause intermittent flow of current through the driven element. The duty cycle of current flow through the driven element determines the average current through the driven element and thus, in the case where the driven element is one or more LEDs, the brightness of the light emitted by each LED. By controlling the duty cycle of the driving current through the driven element to be nearly proportional to the impedance of the driven element, the average current through the driven element is maintained substantially constant regardless of the impedance of the driven element. When the driven element is one or more LEDs, this means that the brightness of the LEDs is substantially constant, regardless of the number of LEDs connected in series to form the driven element. In other words, a one-LED string would exhibit the same brightness as the individual LEDs in a three-LED string.

Circuit 10, constructed in accordance with this invention, determines the impedance of driven element 11 and provides a duty cycle at Q5 proportional to this impedance. This is done through a sequence of steps, the first of which is that the clock signal $\phi$A on node 13 goes high (logical 1). $\phi$A remains high for a one percent duty cycle or less. Node 13 is connected to one input lead of NOR gate 17, so that when the signal on node 13 is high, NOR gate 17 puts a logical 0 on the gate of transistor Q5, thus turning off transistor Q5. Node 13 is also connected through inverter 16 to the gate of transistor Q2, thus the high signal on node 13 also turns off transistor Q2. With transistor Q2 off, no current flows through resistor R2 and transistor Q2 to ground. Thus current from the positive voltage supply +V through the driven element or elements flows only through transistor Q7 to ground. The voltage on terminal 19 is also applied to the gate of N channel transistor Q3, whose drain is connected to the positive voltage supply at node 18 and whose source is connected to the drain of N channel transistor Q4, with the source of N channel transistor Q4 being connected to ground.

Driven element 11 and transistors Q3 and Q4 form a source follower network. That is, Q3 is the source follower and Q4 is the active load reflecting the impedance of the driven element attached to node 19. When transistor Q2 is off, the gates of transistors Q4 and Q7 are at the voltage level of node 19 since no current is flowing through resistor R2, and the current through transistor Q7 is mirrored by the current through transistor Q4 since their gates and sources respectively are commonly connected. This arrangement of elements Q3, Q4, and Q7 is called a Wilson current mirror.

As the impedance of driven element 11 decreases, the voltage level at node 19 increases. This increase causes an increased voltage at the gate to Q7 and thus an increased gate-source voltage drop in transistor Q7, turning transistor Q7 more on. Increase of the drain voltage of Q7 in this configuration obeys a logarithmic function of the drain current of Q7 in this self-biased configuration. Thus a large increase in drain current causes a small increase in the gate voltage of Q7. Therefore transistor Q7 settles at a level in its linear range, having a finite ohmic resistance. When transistors Q5 and Q2 are off, the voltage at node 19 is determined by this ohmic resistance plus the ohmic resistances and threshold drops of driven element 11 connected to node 19. For small ohmic resistance of transistor Q7, the voltage at node 19 is approximately proportional to the impedance of the driven element. Because the voltage at the gate of transistor Q7 is the same as the voltage at the gate of transistor Q4, Q4 also operates in its linear range, serving as a load transistor for the current path from node 18 to ground. The internal resistance of transistor Q4 causes node 27 to reflect the impedance of the driven element attached to node 19. Since the current through transistor Q7 is approximately inversely proportional to the impedance of the driven element connected to node 19, the current through Q4 is approximately inversely proportional to the impedance of the driven element.

Resistor R2 serves to cause transistors Q4 and Q7 to turn off when $\phi$A is low and thus Q2 is on, so that current through the driven element will flow only through Q5, which will be controlled to have a duty cycle proportional to the impedance of the driven element.

During a short time period (typically approximately five to 10 microseconds) after $\phi$A goes high, the transients in the source follower network formed by transistors Q3 and Q4 settle and thereafter the voltage $V_{sense}$ on node 27 equals the voltage on node 19 minus the threshold voltage of transistor Q3. Thus, for greater impedances of the driven element connected to node 19, the voltage at node 19, and thus the voltage at node 27, decreases.

After the transients on Q3 and Q4 have settled, clock $\phi$B (FIG. *3c*) then goes high, thus turning on N channel transistor Q6 and thus connecting node 27 to node 20. Clock $\phi$B has a frequency equal to the frequency of clock $\phi$A, and a duty cycle shorter than the duty cycle of $\phi$A. The non-inverting input lead of voltage comparator 15 is connected to node 20 as is one plate of capacitor C2 (typically 1 to 2 picofarads), whose second plate is connected to ground. Thus, when clock $\phi B$ goes high, capacitor C2 and node 20 (FIG. 3e) are charged to equal the voltage on terminal 27, $V_{sense}$. As explained earlier, the difference between the voltage $V_{sense}$ and the positive supply voltage is approximately proportional to the impedance of the driven element, obeying the equation:

$$V_{sense} = +V - N(V_{LED}) - V'_T;$$

where

N=the number of LEDs in the driven element;

$V_{LED}$=the voltage across each LED; and $V'_T$=the threshold voltage of transistor Q3.

Thus, as shown in FIG. 3d, $V_{sense}$ has a certain value, typically approximately 6.4 volts when the positive supply voltage of +V is approximately 10 volts and the driven element is a single LED. When the driven element is formed of two LEDs connected in series with a positive supply voltage +V equal to 10 volts, the voltage $V_{sense}$ is approximately 4.7 volts. Similarly, as shown in FIG. 3d, when the driven element is three LEDs connected in series with a positive supply voltage +V equal to 10 volts, $V_{sense}$ is approximately 3 volts. It is this voltage $V_{sense}$ which indicates the impedance of the driven element, and serves to adjust the duty cycle of the current which will flow through the driven element and output transistor Q5 to ground during the next portion of a complete operating cycle.

Also, with $\phi A$ high, N channel transistor Q1 is turned on. N channel transistor Q1 has its drain connected to positive supply voltage +V at terminal 12, and its source connected to node 28. Resistor R1 (having a value of approximately 2500 ohms, as determined by the frequency of $\phi A$) has one end connected to node 28 and its other end connected to ground. Capacitor C1 (typically 1 microfarad) has a first plate connected to the positive supply voltage +V at terminal 22, and a second plate connected to node 28. Thus, with transistor Q1 turned on during the period when $\phi A$ is high, capacitor C1 is charged to a value of (+V−Vt) where Vt is the threshold voltage of transistor Q1 (typically about 2.5 volts).

Clock $\phi B$ then goes low, thus turning off transistor Q6 with $V_{20}=V_{sense}$ still stored on capacitor C2. Clock $\phi A$ then goes low causing inverter 16 to provide a logical one output signal to the gate of N channel transistor Q2, thus turning on transistor Q2. Clock $\phi B$ is taken low before $\phi A$ goes low so that the coincident edges of the pluses $\phi A$ and $\phi B$ don't discharge capacitor C2. With $\phi A$ low and transistor Q2 turned on, the gates of transistors Q4 and Q7 are connected to ground, thereby turning off transistors Q4 and Q7 and ceasing the operation of the source follower formed by transistors Q3 and Q4. Since turning on transistor Q2 also lowers the gate voltage on transistor Q7, thus turning off Q7, the amount of current flowing through the driven element and not controlled by the duty cycle of transistor Q5 is small (typically 10 microamps) since it must flow through resistor R2 and transistor Q2 to ground, and it does not cause significant variation in the illumination of the driven element.

With clock $\phi A$ low, transistor Q1 is also turned off. With transistor Q1 turned off, capacitor C1 charges through resistor R1 with time constant R1C1 (where R1 is the resistance of resistor R1 and C1 is the capacitance of capacitor C1), such that $V_{RAMP}$ on node 28 approaches 0 volts as shown in the graphical representation of $V_{RAMP}$ (FIG. 3a). $V_{RAMP}$ (node 28) is connected to the inverting input lead of voltage comparator 15. When the magnitude of $V_{RAMP}$ is greater than the magnitude of V20 stored on capacitor C2, the output signal from voltage comparator 15 is a logical 0. This logical 0 and the logical 0 $\phi A$ signal are applied to the input leads of NOR gate 17, thereby providing a logical 1 output signal $V_{21}$ (FIG. 3f) from NOR gate 17, which in turn causes transistor Q5 to turn on. With transistor Q5 turned on, current flows from the positive supply voltage +V, through the driven element, terminal 19, and transistor Q5 to ground. $V_{RAMP}$ decreases in magnitude as capacitor C1 charges through resistor R1. When the magnitude of $V_{RAMP}$ becomes less than the magnitude of $V_{20}$ as stored on capacitor C2, the output signal from voltage comparator 15 becomes a logical 1, thereby causing the output signal $V_{21}$ from NOR gate 17 to become a logical 0, thus turning off output transistor Q5. With transistor Q5 turned off, most current ceases to flow through the driven element, the only path being through resistor R2 and transistor Q2.

FIGS. 3a–3f show typical timing diagrams for circuits of this inventions driving 3, 2, and 1 LED respectively. FIG. 3d shows values of expected voltage at node 27 representing $V_{sense}$. FIG. 3e shows the response to these voltage levels at node 20 indicating that the voltage at node 20 responds to the voltage $V_{sense}$ at node 27 during the time when $\phi B$, the voltage at node 14, is high. FIG. 3f shows typical duty cycles provided by inverter 15 through AND gate 17 to node 21, the gate to transistor Q5 in the present of driven elements comprising 3, 2, and 1 LED strings respectively.

In summary, the circuit of this invention first samples the impedance of the driven element and stores at node 20 a voltage indicative of that impedance. As that impedance increases, the duty cycle of the current flowing through the driven element increases, thereby maintaining a substantially constant average current through the driven element regardless of the impedance of the driven element.

While this specification illustrates specific embodiments of this invention, it is not to be interpreted as limiting the scope of the invention. Many embodiments of this invention will become evident to those of ordinary skill in the art in light of the teachings of this specification. As but one example of an alternative embodiment of this invention, it will be readily understood by those of ordinary skill in the art in light of the teaching of this invention, that another embodiment of this invention includes an integrator (not shown, but such as a simple RC network) connected between the output lead of NOR gate 17 and the gate of transistor Q5. In this embodiment, the output signal from NOR gate 17 is integrated, and a relatively constant output signal is provided to the gate of transistor Q5, thus causing transistor Q5 to operate in its linear range and provide through terminal 19 a substantially constant drive current which is proportional to the impedance of the driven element connected to terminal 19.

I claim:

1. An electronic circuit for providing drive to a driven element, said driven element having a first lead and having a second lead connected to a first power source, said electronic circuit comprising:

a driving terminal connected to said first lead of said driven element;

a second terminal connected to a second power source;

means for carrying current from said driving terminal to said second terminal;

means for sensing the impedance of said driven element; and means for providing that for a given different between voltage levels of said first and second power sources, the average value of current flowing between said driving terminal and said second terminal remains approximately constant for a range of said impedance of said driven element, comprising:

switch means connected between said driving terminal and said second terminal; and means for operating said switch means in response to said impedance of said driven element such that said switch means is closed for a duty cycle proportional to said impedance of said driven element, said means for operating comprising:

means for providing a sense signal having a sense voltage lower than the voltage of said first power source by an amount approximately proportional to said impedance of said driven element; and means responsive to said sense signal for controlling said duty cycle of said switch means to be proportional to said sense voltage comprising:

means for generating a ramp voltage; and means for comparing said sense voltage to said ramp voltage and providing to said switch means a drive signal when said ramp voltage is greater than said sense voltage.

2. An electronic circuit for providing drive to a driven element, said driven element having a first lead and having a second lead connected to a first power source, said electronic circuit comprising:

a driving terminal connected to said first lead of said driven element;

a second terminal connected to a second power source;

means for carrying current from said driving terminal to said second terminal;

means for sensing the impedance of said driven element; and means for providing that for a given difference between voltage levels of said first and second power sources, the average value of current flowing between said driving terminal and said second terminal remains approximately constant for a range of said impedance of said driven element, said means for providing comprising:

switch means connected between said driving terminal and said second terminal; and means for operating said switch means in response to said impedance of said driven element such that said switch means is closed for a duty cycle proportional to said impedance of said driven element, said means for operating comprising:

means for providing a sense signal having a sense voltage lower than the voltage of said first power source by an amount approximately proportional to said impedance of said driven element; and means responsive to said sense signal for controlling said duty cycle of said switch means to be proportional to said sense voltage comprising:

a first clock input terminal receiving a first clock input signal;

a NOR gate having a first input terminal connected to said first clock input terminal, a second input terminal, and an output terminal connected to said means for said operating said switch means; and a comparator having a non-inverting input terminal provided with said sense voltage, an inverting input terminal provided with a voltage which ramps from the voltage of said first power source toward the voltage of said second power source during the time when said first clock input signal is in a first state, and an output terminal connected to said second terminal of said NOR gate.

3. An electronic circuit as in claim 2 where said voltage which ramps smoothly is provided by a structure comprising:

a storage means having a first terminal connected to said first power source and a second terminal connected to said inverting input terminal and through a resistance means to said second power source; and switch means having a first current carrying terminal connected to said first power source, a second current carrying terminal connected to said inverting input terminal, and a first control terminal connected to said first clock input terminal.

4. An electronic circuit as in claim 2 where said sense voltage is provided by:

a storage means having a first terminal connected to said non-inverting input terminal and a second terminal connected to said second power source;

a second clock input terminal having a second clock input signal; and second switch means having a first current carrying terminal connected to said means for providing a sense signal, a second current carrying terminal connected to said first terminal, and a control terminal connected to said second clock input terminal.

5. An electronic circuit for providing drive to a driven element, said driven element having a first lead and having a second lead connected to a first power source, said electronic circuit comprising:

a driving terminal connected to said first lead of said driven element;

a second terminal connected to a second power source;

means for carrying current from said driving terminal to said second terminal;

means for sensing the impedance of said driven element, comprising:

a first transistor having a first current carrying terminal connected to said driving terminal and a second current carrying terminal connected to said second power source, resistance means having a first terminal connected to said driving terminal and having a second terminal connected to a control terminal of said first transistor, a second transistor having a first current carrying terminal connected to said control terminal of said first transistor and a second current carrying terminal connected to said second power source, a third transistor having a first current carrying terminal connected to said first power source and having a control terminal connected to said driving terminal, and a fourth transistor having a first current carrying terminal connected to a second current carrying terminal of said third transistor, a second current carrying terminal connected to said second power source, and a control terminal connected to said control terminal of said first transistor, the output of said means for sensing being taken from said first current carrying terminal of said fourth transistor, said output providing a sense voltage lower than the voltage of said first power source by an amount approximately proportional to said impedance of said driven element; and means for providing that in response to said sense voltage the average value of current flowing between said driving terminal and said second terminal remains constant for a range of values of said sense voltage comprising:

switch means connected between said driving terminal and said second terminal, and means for operating said switch means such that said switch means is closed for a duty cycle proportional to said sense voltage.

6. An electronic circuit as in claim 5 in which said means for operating said switch means comprises:

means for generating a ramp voltage; and means for comparing said sense voltage to said ramp voltage and providing to said switch means a drive signal when said ramp voltage is greater than said sense voltage.

* * * * *